US006688047B1

(12) United States Patent
McNichol

(10) Patent No.: US 6,688,047 B1
(45) Date of Patent: Feb. 10, 2004

(54) SNOW RETENTION APPARATUS AND METHOD OF INSTALLATION

(75) Inventor: John Joseph McNichol, Holland, PA (US)

(73) Assignee: Berger Financial Corp., Wilmington, DE (US)

( * ) Notice: Subject to any disclaimer, the term of this patent is extended or adjusted under 35 U.S.C. 154(b) by 0 days.

(21) Appl. No.: 10/057,520

(22) Filed: Jan. 24, 2002

(51) Int. Cl.[7] ..... E04D 13/10
(52) U.S. Cl. ..... 52/25; 52/741.3
(58) Field of Search ..... 52/24, 25, 26, 52/741.3; 182/45, 113; 256/12.5, 65.03, 65.06

(56) References Cited

U.S. PATENT DOCUMENTS

| | | | | |
|---|---|---|---|---|
| 42,992 | A | | 5/1864 | Howe |
| 58,411 | A | | 10/1866 | Hathorn |
| 97,316 | A | | 11/1869 | Rogers |
| 106,580 | A | | 8/1870 | Hathorn |
| 188,287 | A | | 3/1877 | Dugan |
| 193,809 | A | | 8/1877 | Dugan |
| 529,774 | A | | 11/1894 | Baird |
| 756,884 | A | | 4/1904 | Parry |
| 2,079,768 | A | | 5/1937 | Levow |
| 2,201,320 | A | * | 5/1940 | Place |
| 4,909,483 | A | * | 3/1990 | van Herpen |
| 4,919,394 | A | * | 4/1990 | Otte et al. |
| 5,113,971 | A | * | 5/1992 | Violet |
| 5,152,107 | A | | 10/1992 | Strickert |
| 5,189,849 | A | | 3/1993 | Collins |
| 5,228,248 | A | | 7/1993 | Haddock |
| 5,271,194 | A | | 12/1993 | Drew |
| 5,282,340 | A | | 2/1994 | Cline et al. |
| D351,989 | S | | 11/1994 | Cline et al. |
| D364,338 | S | | 11/1995 | Cline |
| 5,483,772 | A | | 1/1996 | Haddock |
| 5,491,931 | A | | 2/1996 | Haddock |
| 5,522,185 | A | | 6/1996 | Cline |
| D372,421 | S | | 8/1996 | Cline |
| 5,557,903 | A | | 9/1996 | Haddock |
| 5,609,326 | A | | 3/1997 | Stearns et al. |
| 5,613,328 | A | | 3/1997 | Alley |
| 5,694,721 | A | | 12/1997 | Haddock |
| 5,715,640 | A | | 2/1998 | Haddock |
| 5,732,513 | A | | 3/1998 | Alley |
| 5,896,944 | A | * | 4/1999 | McMillian et al. |
| 5,983,588 | A | | 11/1999 | Haddock |
| D418,403 | S | | 1/2000 | Cline |
| 6,164,033 | A | | 12/2000 | Haddock |
| 6,298,608 | B1 | * | 10/2001 | Alley |

FOREIGN PATENT DOCUMENTS

| | | | | |
|---|---|---|---|---|
| JP | 5-346055 | * | 12/1993 | ..... E04D/13/10 |

* cited by examiner

*Primary Examiner*—Robert Canfield
(74) *Attorney, Agent, or Firm*—Wolf, Block, Schorr and Solis-Cohen LLP; Eric A. Dichter

(57) ABSTRACT

An apparatus for retaining and controlling the size of pieces of snow and/or ice accumulating on a roof contains brackets secured to the roof and rails passed between the brackets to form a frame structure. The brackets have slots and/or pockets for fitting rails and enable the rails to be at or below the level of seams on seamed roofs and at a low profile with non-seamed roofs. In addition, the brackets may be attached to the roof without penetrating the roof structure. A method of installing a snow and/or ice retaining apparatus includes lowering the rails into pockets on the brackets, sliding the rails into slots on the brackets, and, optionally, securing the rails with a clip, wedge, or adhesive.

40 Claims, 10 Drawing Sheets

SNOW RETENTION APPARATUS AND METHOD OF INSTALLATION

FIELD OF THE INVENTION

The present invention relates to the retention of snow and ice on the roofs of buildings. More particularly, the present invention is directed to a snow retention apparatus that attaches to roofs to form a fence-like structure that prevents snow and ice from sliding off of the roof in large pieces, and a method of installing such an apparatus.

BACKGROUND OF THE INVENTION

For roofs commonly used in buildings, such as office buildings, barns, and residential houses, it is desirable to incorporate a frame structure on the roof, especially roofs with steep pitches. The frame structure is able to control the movement of snow and/or ice on the roof by obstructing the snow and/or ice. It can also be used as a safety device, to which workers can secure themselves using harnesses to protect against sliding off of a building's roof.

When used for snow/ice retention, the frame structure prevents the pitch of the roof from causing the snow and/or ice to slide off of the roof in large pieces. Snow and/or ice can only form pieces that fit within openings of the frame structure and the thickness of pieces sliding off of the roof is limited to the height of the frame structure above the roof's top surface.

Snow or ice sliding off of a roof, especially in large pieces, can be dangerous to people near the building, and it can damage property items (e.g., cars); natural landscape features; other components of the building (e.g., gutters, antennas, satellite dishes, etc.); and utility lines; among other items situated near the building. Large pieces of snow and ice frequently slide off of metal roofs, such as standing seam metal roofs, which can result in bodily injury and/or damage.

Standing seam roofs, which may be made out of metal or other suitable materials, are used in various structures, usually soaring structures, such as churches, cathedrals, barns, and industrial buildings. The points where roof panels are connected form raised seams; the seams generally run parallel along the roof. The top surfaces of metal seam roofs are often smooth, lacking the friction associated with roofs made of asphalt shingles and similar roofing materials. The smoothness increases the danger associated with the roof by facilitating the sliding of snow and/or ice and increasing the likelihood that workers on the roof will slip or slide on the roof.

Various mechanisms have been used as frame structures to prevent snow and/or ice from sliding off of roofs. These mechanisms have included brackets attached to the roof, including snow stop hardware, such as flags attached to frames. In addition, frame structures have been formed by passing cylindrically-shaped rods or other posts through the brackets. In those frame structures, rods or other posts prevent the snow and/or ice from forming large or thick pieces that can slide off of the roof.

Although in some instances, frame structures have been held onto the roof by a series of wires linking brackets on the roof, i.e., a net-like configuration, in many instances, the brackets of the frame structure have been permanently attached to the roof with nails, screws, or bolts. Also, the frame structures have been attached to the roof by passing hook-like supports around the lower edges of slate or shingles; the supports are set into the roof board by screws, bolts, or spikes. The nails, screws, bolts, and spikes used to attach frame structures to a roof penetrate the roofing material which can cause leaking and other problems. Also, these types of fasteners require permanent installation of the brackets, such that if the brackets are removed, the roof must be repaired.

With standing seam roofs, there have been attempts to attach a frame structure to the roof using a friction fit on the seams and/or by deforming the seams for better adhesion to the brackets used in the frame structure. The frame systems previously used with standing seam roofs have incorporated their snow retention rail systems at a height above the roof seams. Thus, this height for the rail system would allow a build up of snow and/or ice up to or above the level of the seams of the roof, i.e., up to the height of the rails. The conventional snow retention systems have not provided rails or posts at or below the level of the seams.

In addition, with conventional rail systems, the cylindrically-shaped rails or posts, which primarily function to control the snow and/or ice on the roof, must be threaded through holes in the brackets before or after installation of the brackets. Threading of the rails or posts through such holes on the roof can be difficult and dangerous. Also, changing the positioning of the rails or posts is very difficult, and the holes in the brackets may not allow for versatility in rail or post placement. Further, the cylindrically-shaped rails or posts do not have the force resistance of posts having a more squared shape.

There is a continuing need for a snow retention rail system for roofs in which there is versatility in the placement of rails, rails are at or below the level of seams on roofs, and rails are square, rectangular, triangular, D-shaped, or similarly shaped.

SUMMARY OF THE INVENTION

The present invention comprises an apparatus for retaining snow and/or ice on a roof, thus preventing large pieces from sliding off of the roof and causing damage, and a method of installing such an apparatus. In its most general form, the apparatus of the present invention comprises clamping brackets secured to a roof and having slots or pockets in which rails are seated. The rails pass through two or more clamping brackets lined up on the roof. The clamping brackets and rails are made of material which provides suitable structural integrity, such as ferrous or non-ferrous metals, aluminum, steel, alloys of aluminum or steel, Kevlar, bronze, bronze alloys, polycarbonate and other plastic resins.

In one embodiment, the clamping brackets form a channel for placement on the seams of metal seam roofs. The clamping brackets are secured to the seams of the roof through a friction fit. The friction fit may be created by opposed blunt-end and cupped screws passed through apertures on either side of the clamping brackets to contact the seams.

In another embodiment, the apparatus of the present invention can be used with roof systems other than seamed roofs, such as slate, tile, metal roofing, cementious synthetic roofing materials, or membrane roofing fabrics. With these roof systems, the clamping brackets are fastened directly to the roof surface or are attached to a plate, bar, or strap that is connected to the roof surface.

In one embodiment of the method of installing the apparatus of the present invention, the rails are placed into the pockets or slots of the clamping brackets and are secured by gravity, a retention apparatus, such as a clip or wedge, and/or a suitable adhesive.

In an alternative embodiment, the apparatus of the present invention comprises a fence-like frame structure installed on roofs for providing support for workers on the roof.

It is to be understood that both the foregoing general description and the following detailed description are exemplary, but are not restrictive, of the invention.

BRIEF DESCRIPTION OF THE DRAWINGS

The present invention is best understood from the following detailed description when read in connection with the accompanying drawings. It is emphasized that, according to common practice, the various features of the drawings are not to scale; rather, the dimensions of the various features are arbitrarily expanded or reduced for clarity. Included in the drawings are the following figures.

DETAILED DESCRIPTION OF THE INVENTION

The present invention comprises an apparatus for retaining snow and/or ice on a roof and a method of installing such an apparatus. The apparatus contains clamping brackets that are attached to the roof, and rails that are placed between the brackets to form a frame-like structure for retaining and/or controlling the snow and/or ice. The brackets contain pockets and/or slots in which rails are seated. For standing seam roofs, the brackets contain a channel that fits over the seams and allows for attachment to the seams.

The brackets may be attached to standing seams through a friction fit enabled by any suitable fastening device in contact with the brackets and seams, such as screws or wedges. In one embodiment, opposed blunt-end (e.g., ball shaped) and cup-shaped screws are threaded through apertures in the brackets and engage the seams; the engagement of the seams by the screws may cause a deformation of the seams. The dual-edged screws increase the resistance of the brackets to torquing off (tearing off). The screws may be 7/16-inch diameter or any other screw diameter compatible with the brackets and roof seam. The brackets are generally attached to seams up to 1.5 inches high and up to 0.5 inches wide; however, seams of other dimensions can be accommodated by the present invention.

Figure 17:
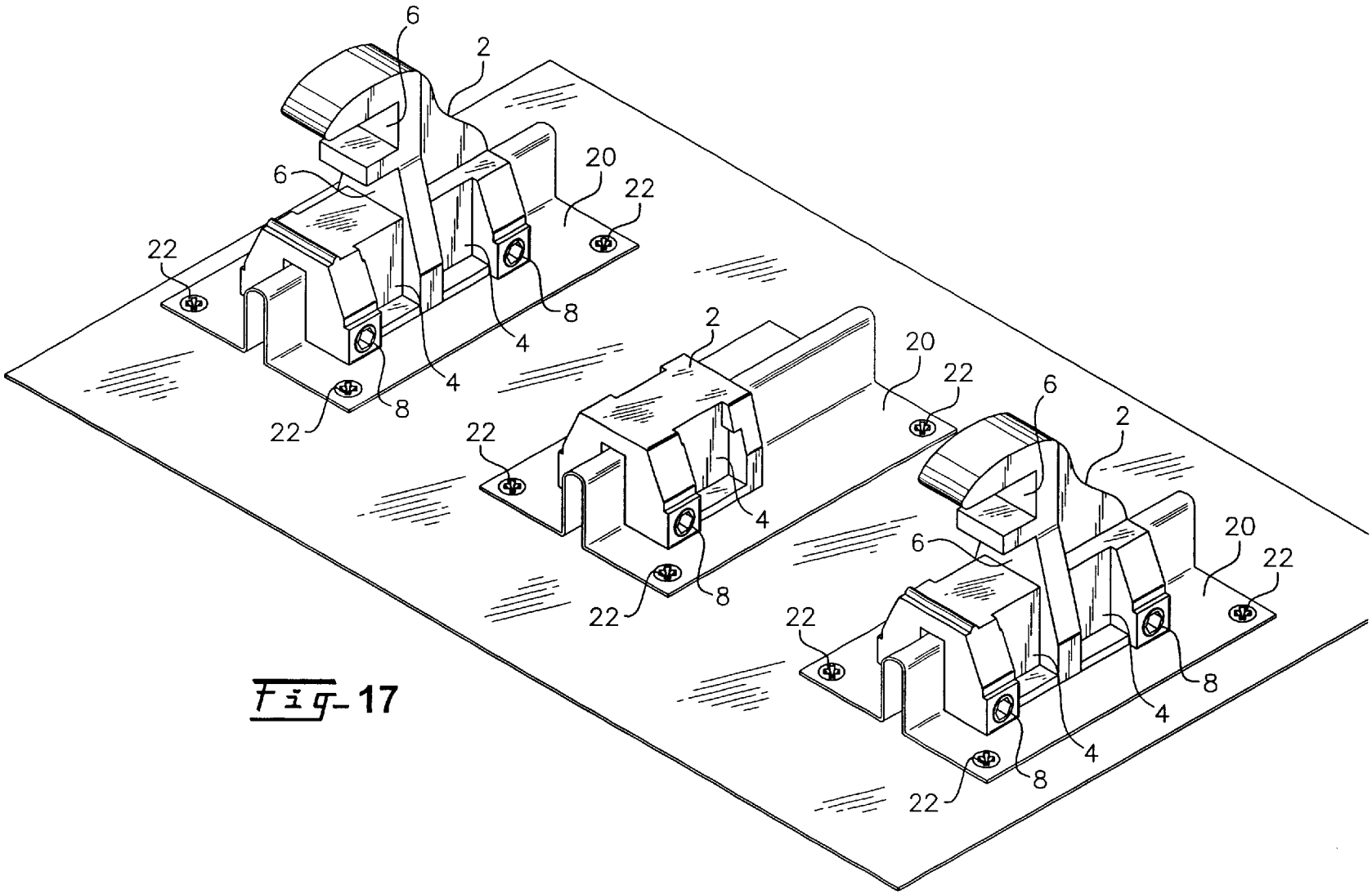
FIG. 17 is a perspective view of multiple embodiments of the brackets connected to plates used in the apparatus of the present invention.

For non-seamed, flat surface roots, the brackets are connected to a plate 20 (as shown in FIG. 17), bar, or strap connected to the roof material. Alternatively, the brackets are directly connected to the roof using screws, nails, bolts, spikes, or any other suitable fastener. Such non-seamed roofs include cementious (asphalt) shingle, natural slate, tile, metallic, non-metallic, synthetic slate, rubber, and membranous roofs.

Figure 1:
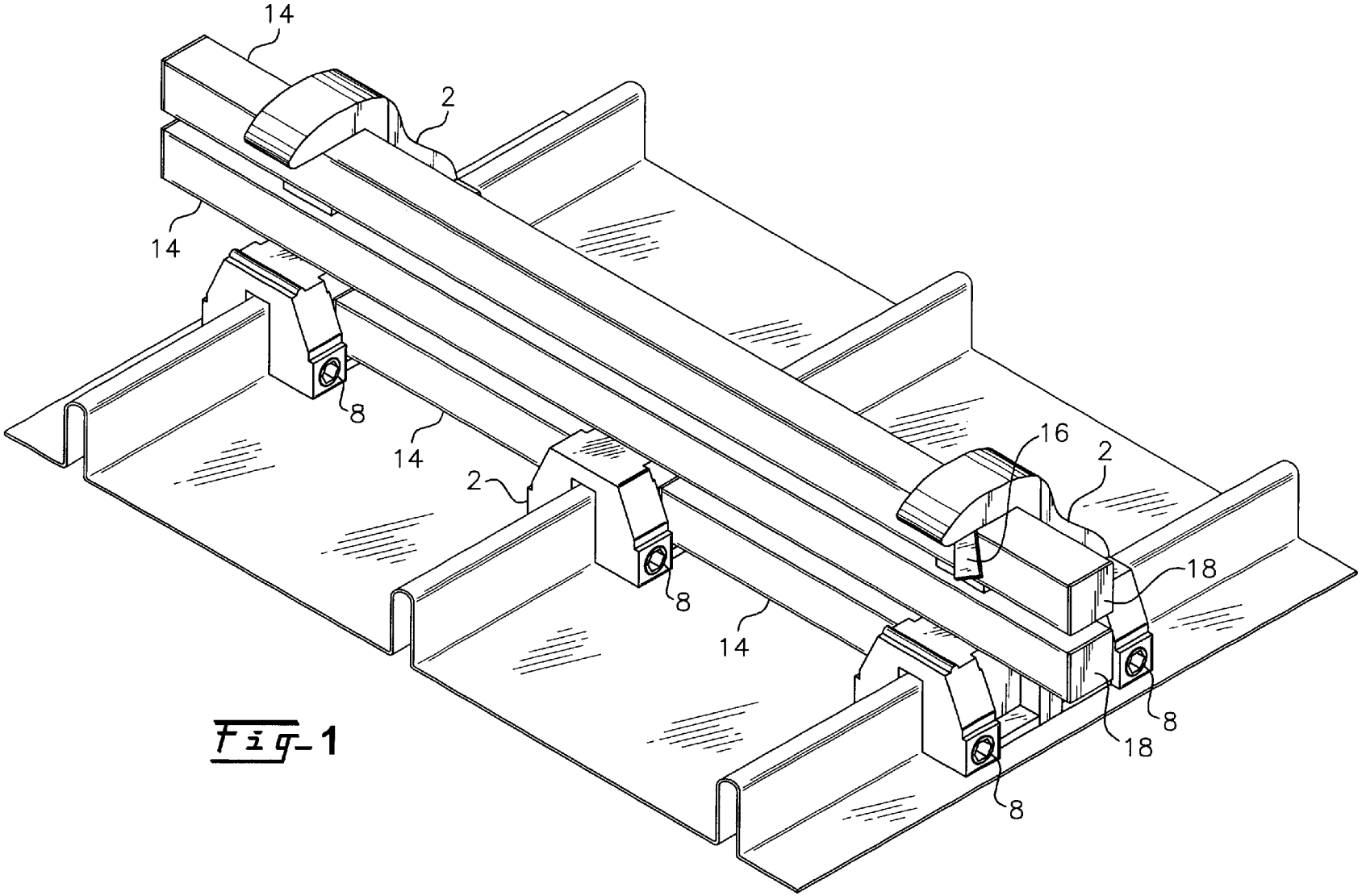
FIG. 1 is a perspective view of one embodiment of the brackets and rails used in the apparatus of the present invention.
Figure 2:
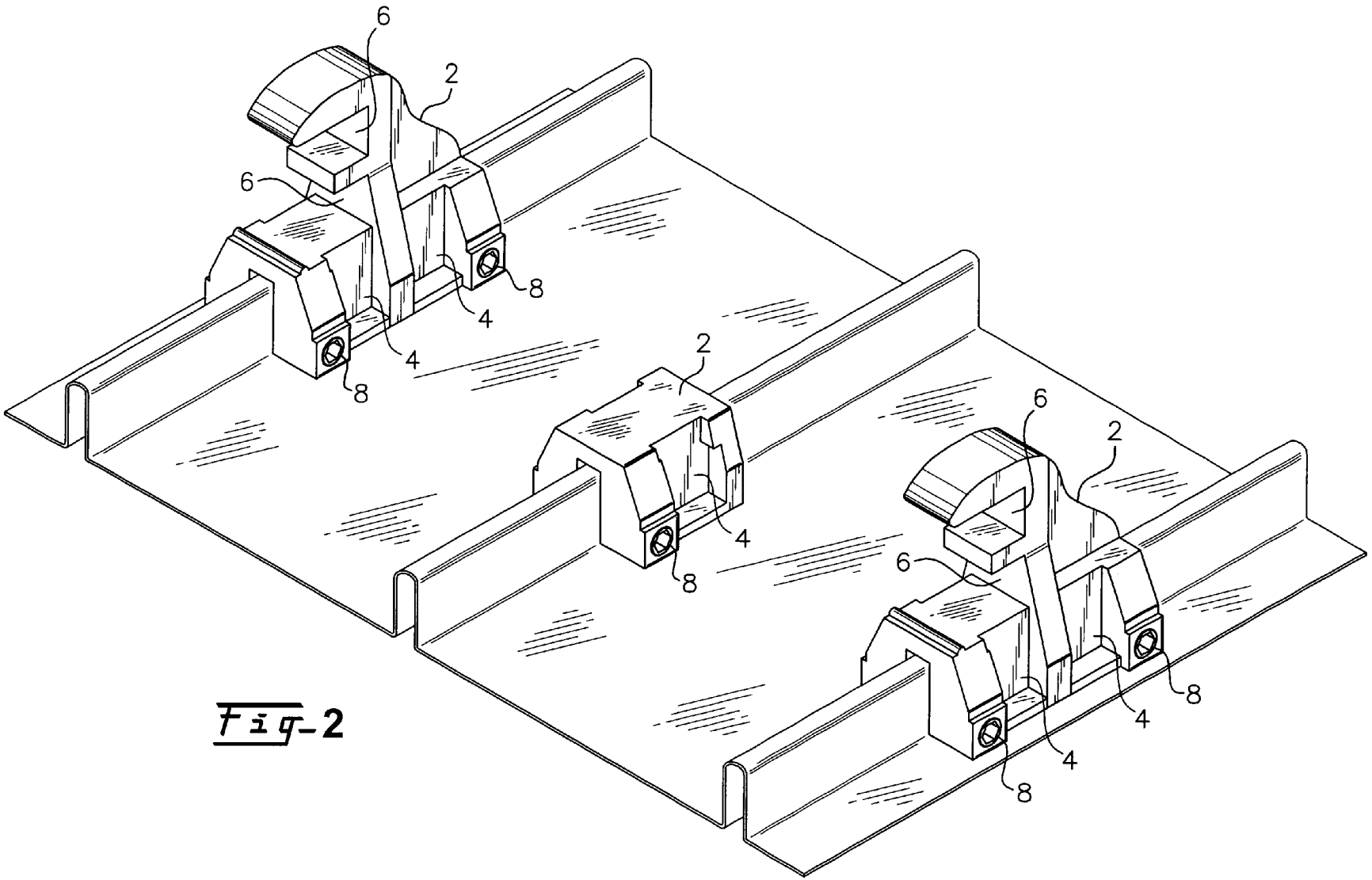
FIG. 2 is a perspective view of multiple embodiments of the brackets used in the apparatus of the present invention.

As shown in FIGS. 1 and 2, the snow/ice retention apparatus comprises a clamping bracket 2, made of a suitable structural material (metal or plastic), such as aluminum, steel, brass, copper, Kevlar, bronze, polycarbonate and other plastic resins, and alloys of aluminum, steel, brass, copper, Kevlar, and bronze, which is attached to a roof. The bracket 2 has pockets 4, formed by seams in the bracket 2, and open slots 6 for holding rails 14; the brackets 2 and rails 14 form the frame structure of the snow/ice retention apparatus. The rails 14 can be made of aluminum, steel, brass, copper, Kevlar, bronze, polycarbonate and other plastic resins, and alloys of aluminum, steel, brass, copper, Kevlar, and bronze, or any other tubing or solid rod structure and compatible with the brackets 2 and roof type. The tubing may be hollow with closures (or caps) 18 at the ends of the rails. Alternatively, rails 14 are made of a solid rod of one or more materials.

Figure 15:
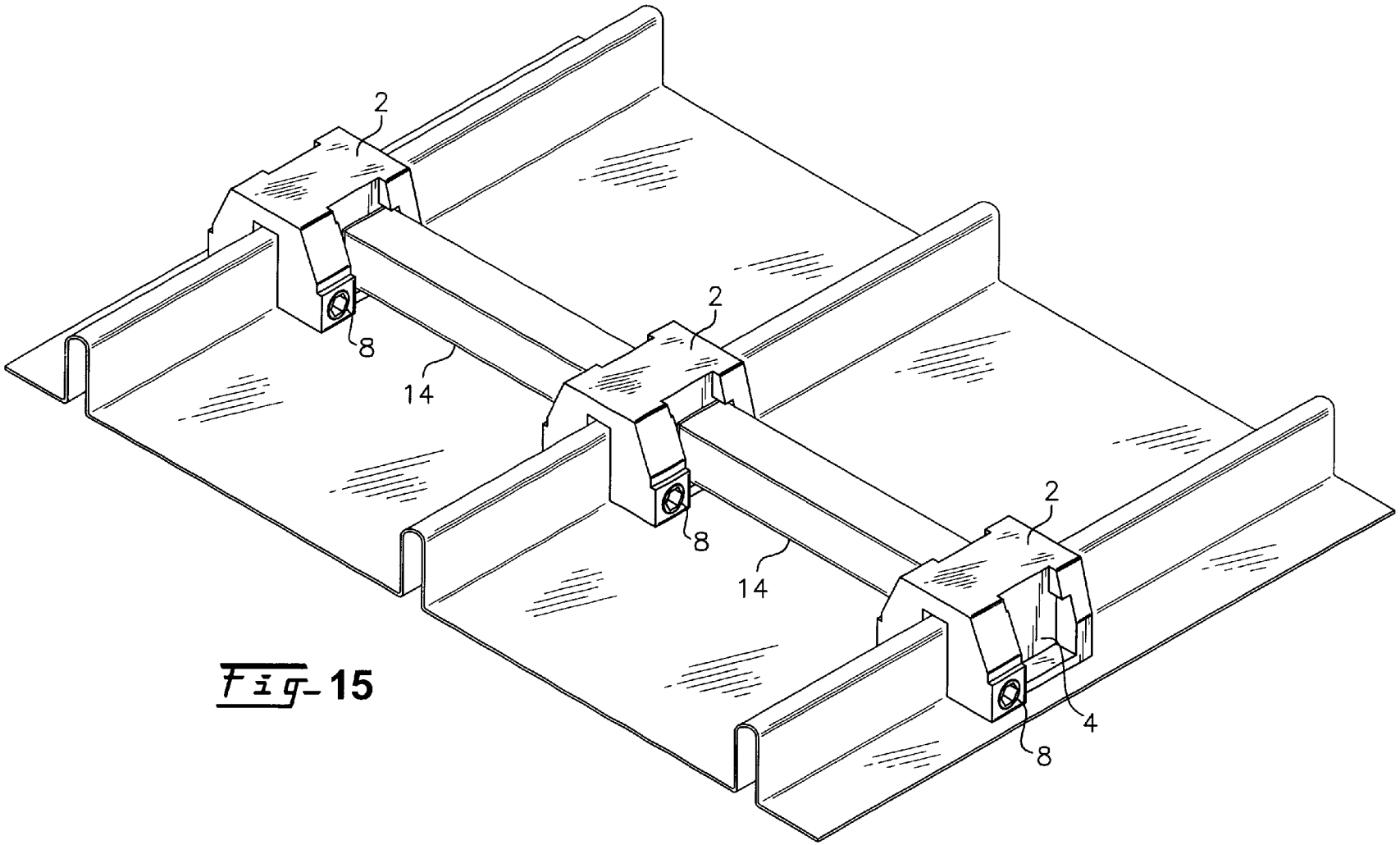
FIG. 15 is a perspective view of an alternative embodiment of the brackets and rails used in the apparatus of the present invention.
Figure 16:
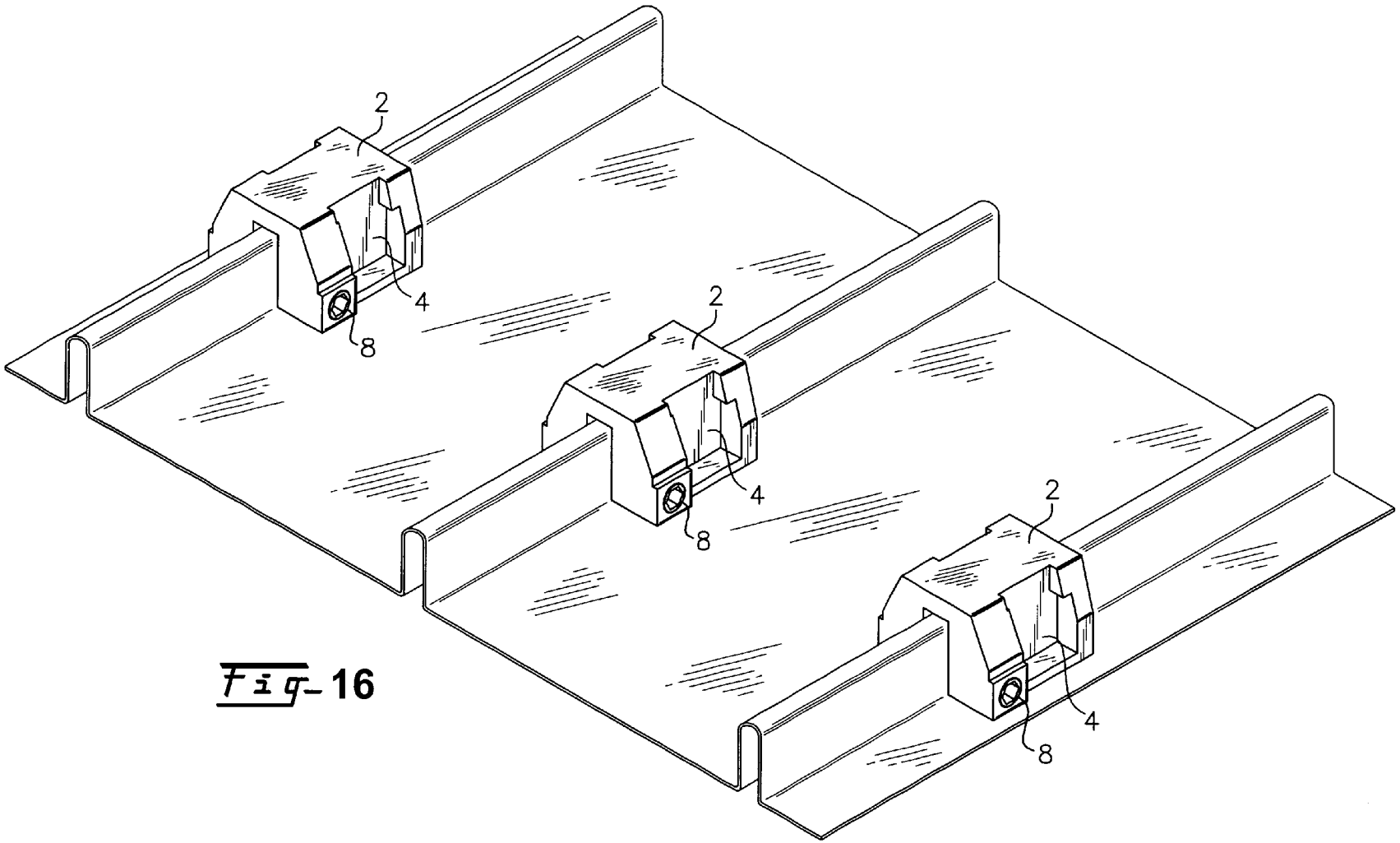
FIG. 16 is a perspective view of an alternative embodiment of the brackets used in the apparatus of the present invention.

As shown in FIGS. 1 and 2, the brackets 2 on the outside seams have multiple pockets 4 and slots 6. Meanwhile, the bracket on the middle seam has one pocket 4. In FIGS. 15 and 16, the brackets 2 on all seams have a single pocket 4 for holding the brackets 14. These figures demonstrate the variations and different arrangements of brackets enabled by the present invention.

Figures 3, 4, 5:
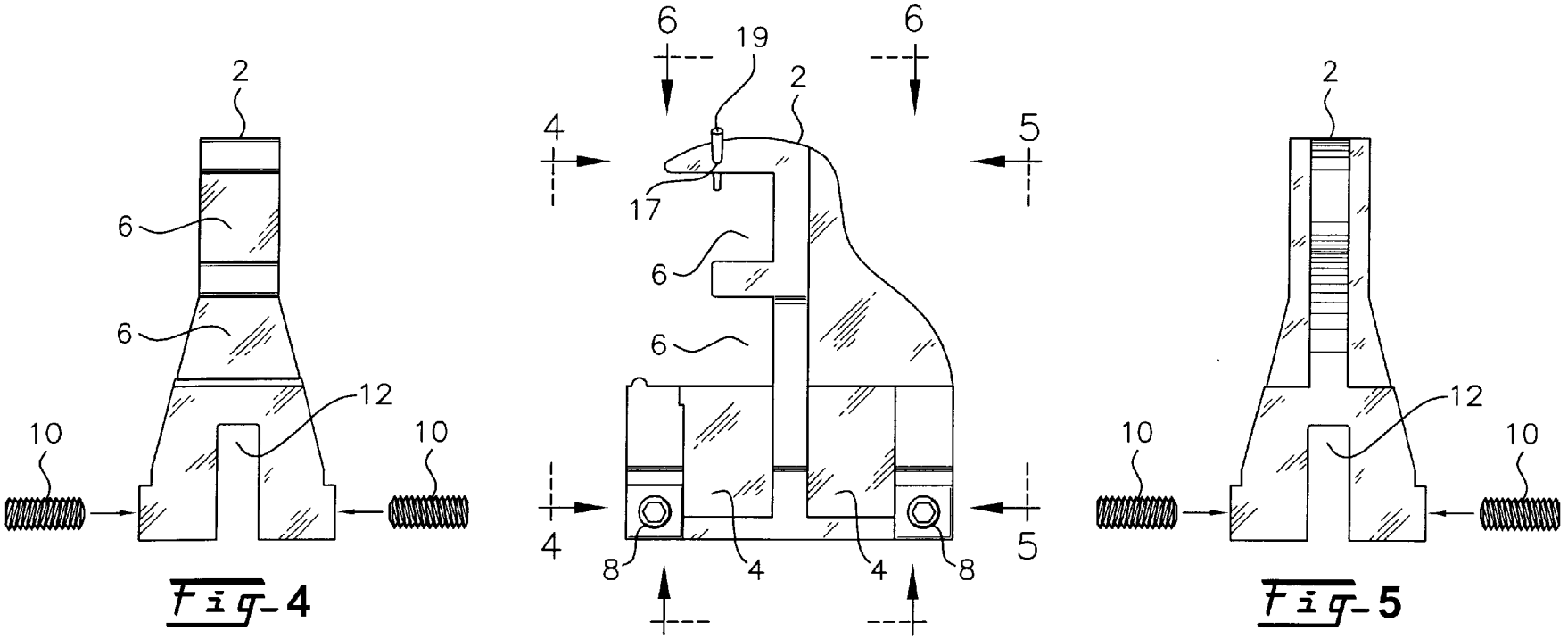
FIG. 3 is a side view of an embodiment of the bracket used in the apparatus of the present invention.
FIG. 4 is a rear view of an embodiment of the bracket used in the apparatus of the present invention.
FIG. 5 is a front view of an embodiment of the bracket used in the apparatus of the present invention.
Figure 7:
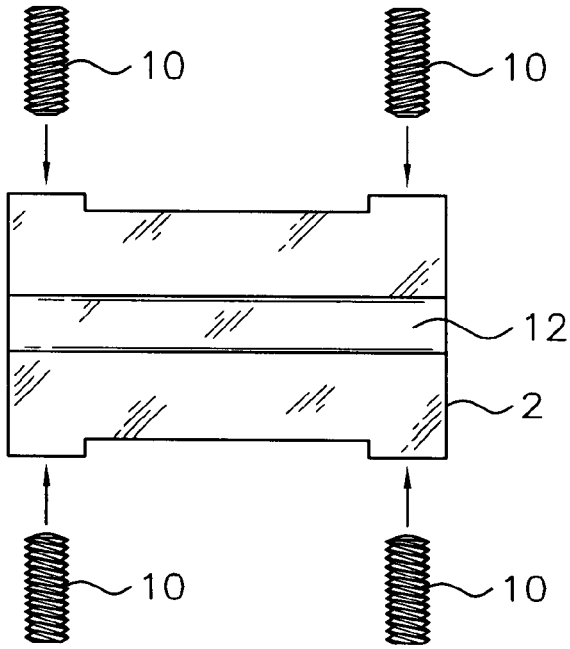
FIG. 7 is a bottom view of an embodiment of the bracket used in the apparatus of the present invention.
Figure 8:
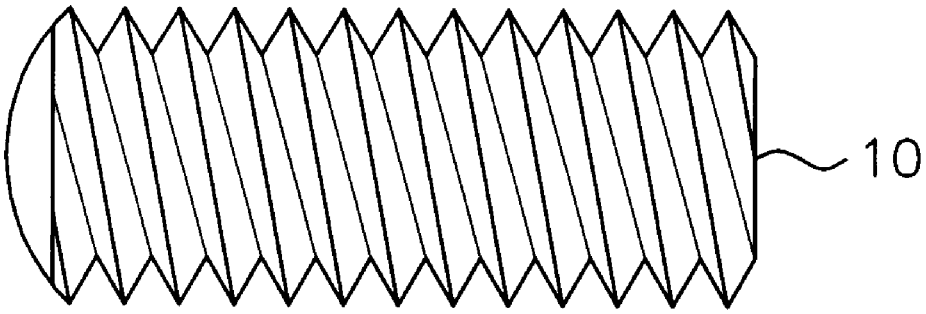
FIG. 8 is a side view of one embodiment of a screw used in the bracket of the present invention.
Figure 9:
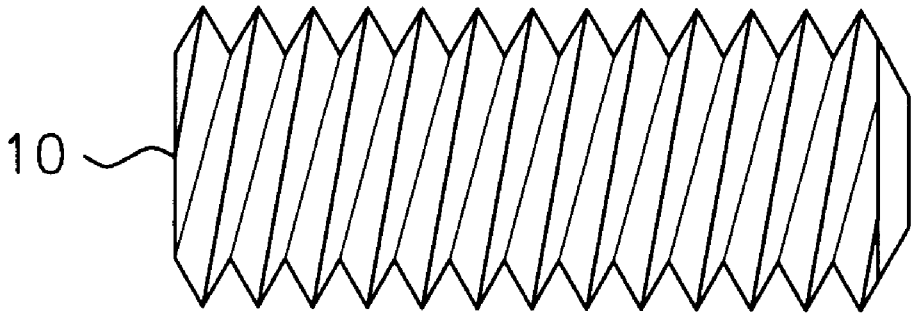
FIG. 9 is a side view of another embodiment of a screw used in the bracket of the present invention.
Figure 12:
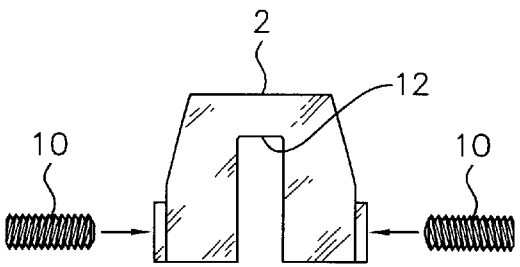
FIG. 12 is a rear view of an alternative embodiment of the bracket used in the apparatus of the present invention.
Figure 10:
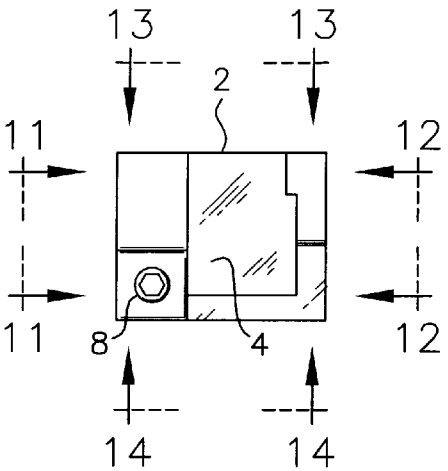
FIG. 10 is a side view of an alternative embodiment of the bracket used in the apparatus of the present invention.
Figure 11:
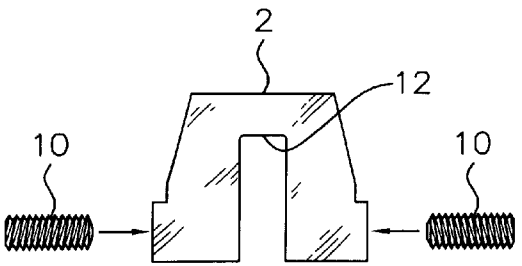
FIG. 11 is a front view of an alternative embodiment of the bracket used in the apparatus of the present invention.
Figure 13:
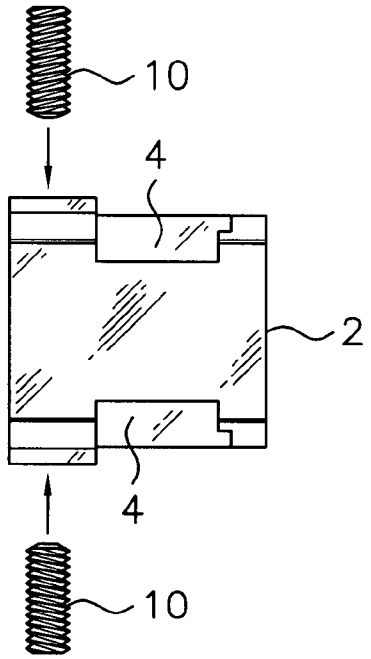
FIG. 13 is a top view of an alternative embodiment of the bracket used in the apparatus of the present invention.
Figure 14:
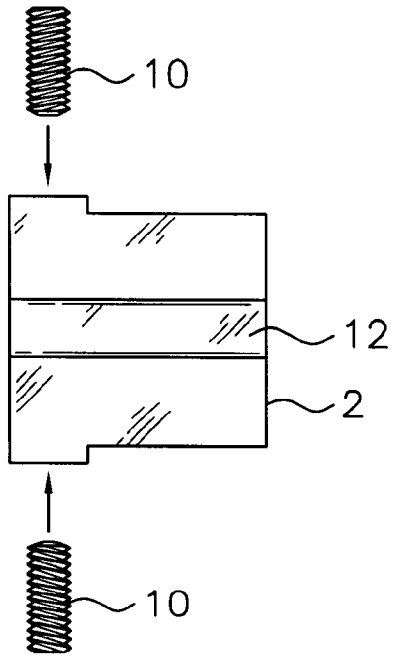
FIG. 14 is a bottom view of an alternative embodiment of the bracket used in the apparatus of the present invention.

As shown also in FIGS. 4, 5, and 7, the bracket 2 has a channel 12 which fits over and is secured to the seams of seamed roofs, such as standing seam metal roofs. FIG. 4 is a rear view of the bracket 2 and FIG. 5 is a front view of the bracket 2 in which the opening of the slots 6 faces the upward-sloping direction of the roof. When attaching to seamed roofs, opposing blunt-end screws 10, such as the screw in FIG. 8, and cup-shaped screws 10, such as the screw in FIG. 9, or, alternatively, wedges 10 or other suitable fastening devices 10 are threaded through the apertures 8 (shown in FIG. 3) in the bracket 2. The screws 10 contact the roof seam and hold the bracket 2 in place by a friction fit. No penetration of the roofing surface needs to be made in attaching the bracket 2. Further, use of the blunt-ended and cup-shaped screws 10 provides sufficient stability to the clamping bracket 2 to prevent or significantly reduce rattling of the clamping bracket 2. This arrangement provides a dual action for the fastening devices, i.e., pushing and pulling.

FIGS. 10–14 show an alternative embodiment of the bracket 2 of the present invention. This embodiment of the bracket 2 has a single pocket 4 for holding rails 14. It also has a channel 12 which fits on top of seams when the bracket 2 is attached to seamed roofs.

In one embodiment of the present invention, as shown in FIG. 17, the bracket 2 is attached to non-seamed roofs, such as asphalt shingle, natural slate, tile, metallic, non-metallic, synthetic slate, rubber, and membranous roofs, with a plate 20 secured to the roof surface using nails, screws, spikes, bolts, and similar plate fastening devices 22. The plate fastening devices 22 are threaded through the apertures in the plate 20 and penetrate the roof surface. Referring back to FIGS. 10–14, the plate can be T-shaped such that the flat surface is attached to the roof and the protruding portion fits into the channel 12 of the clamping bracket 2. The plate is capable of preventing leaking problems associated with penetration of the roof surface and can provide a proper seal for roofs, such as membranous roofs. The plate is then attached to the bracket 2 by screws 10 or other fastening devices 10 threaded through holes in the bracket 2 to contact the plate in substantially the same way as the bracket 2 is attached to the seams of seamed roofs, as described above.

In addition to the plate, a bar or a strap may be attached to the roof and the bracket 2 to secure the bracket 2 to the roof. The strap may be run across the top surface of the roof and be attached at certain points on the roof. The bar may be secured to the top surface of the roof with fastening devices 10, as described above. The bracket 2 is then secured to the strap or bar with similar type fastening devices 10.

The frame structures on non-seamed roofs allow the rails 14 to be low profile, up to about 0.3 inches from the surface of the roof. This prevents thick pieces of snow or ice from forming on a roof and sliding off of the roof from underneath the frame structure.

The clamping bracket 2 allows for versatility in frame configurations. The clamping bracket 2 can accommodate up to four rails 14 in the pockets 4 and slots 6 depending on frame needs. Multiple rails 14 disperse the force of the snow and/or ice on the roof. Also, because the pockets 4 are positioned on the front and back of the bracket 2, a rail 14 positioned in the front of the bracket 2 can provide a force vector for deflection of the snow and/or ice such that the retaining force is spread between different rails 14.

In addition to rails 14 preferably having a rectangular or square cross-section, the pockets 4 and slots 2 of the clamping bracket 2 can accommodate cylindrical rods or rails. The rails 14 commonly have a square cross-section of about one-inch square. This is in contrast to conventional frame structures that have round holes through which only cylindrical rods may be threaded.

The rails 14 preferably have a geometric shape in which sides form angles, such as square, rectangular, triangular, trapezoidal, rhomboid, parallelogram, or D-shaped cross-section. This shape provides a better force vector than with cylindrical rails (rods) for retaining the snow and/or ice. Specifically, the round (cylindrical) rails only provide one point of contact while the cross-sectional shapes of the rails 14 of the present invention provide multiple points of contact. The greater number of contact points increases the force deflection ability.

In addition, the rails 14 of the present invention provide maximum force resistance at a low leverage torque resisting position. That is, the lower profile of the rails 14 in relation to the roof and the cross-sectional shape provide a greater resistance to the rails being torqued off (torn off) the roof by forces caused by debris and the weather.

Figure 6:
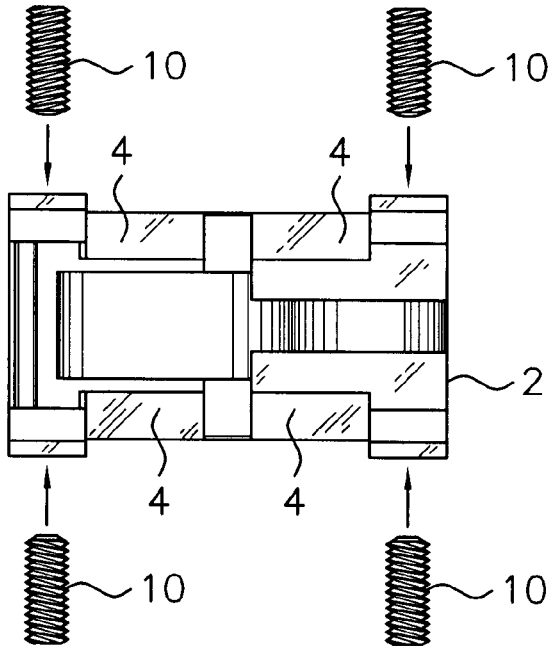
FIG. 6 is a top view of an embodiment of the bracket used in the apparatus of the present invention.

An additional feature of the present invention is the method of installation of the snow/ice retention apparatus. Rails 14 are inserted into the clamping bracket 2 by lowering the rails 14 into the pockets 4 (as shown via top views in FIGS. 6 and 13) of two or more clamping brackets 2. In addition, rails 14 are slid into the slots 6 of two or more clamping brackets 2. The pockets 4 and slots 6 of the clamping bracket 2 enable rails 14 to be inserted or removed without moving the clamping brackets 2. The rails 14 do not have to be threaded into the pockets 4 or slots 6. Although the rails 14 generally are secure in the pockets 4 and slots 6, from the force of snow/ice and/or gravity, a retention device 16, such as a clip or wedge as shown in FIG. 1, can be used to further secure the rails 14. Alternatively, as shown in FIG. 3, a hole 17 in the clamping bracket 2 receives a pin 19 to further secure the rails 14 in the slots 6. Adhesives, caulks and sealants, for example, those that are tri-polymer or silicone-based, may be used to further secure the rails 14 in the pockets 4 or slots 6 and to compensate for shrinking of metal or other materials.

In addition to being a snow/ice retention apparatus, the frame of the present invention can be used as a safety feature for roofs on which individuals are performing construction, maintenance, or repair work. The same overall structure of clamping brackets 2, rails 14, and, if necessary, plates can be used to accommodate an appropriate frame design for a particular roof.

In an exemplary embodiment of the present invention, the clamping bracket 2 is made of the metal alloy, ALMAG 356 or other nonferrous alloy, aluminum, bronze, cast steel, polycarbonate, or any other suitable structural material. The width of the pockets 4 and slots 6 is about 1.01 inches, and the width of the channels 12 is about 0.516 inches. The height of the clamping bracket 2 is about 1.9 inches and its width is about 2.3 inches. The depth of the pockets 4 is about 0.37 inches. The dimensions of the bracket 2 can be adjusted to accommodate different roofs and seams and are not limited by those in the exemplary embodiment.

In an alternative embodiment of the present invention, as shown in FIGS. 1, 2 and 8–12, the bracket 2 has a single pocket 4 for receiving a rail 14. The bracket 2 has apertures 8 which receive screws 10 for securing to seams of roofs and attachments to non-seamed roofs, as described above. In this embodiment, the rails 14 which are seated in each bracket's pocket 4 are all at low profile with the roof underneath the seams.

Although illustrated and described above with reference to certain specific embodiments, the present invention is nevertheless not intended to be limited to the details shown. Rather, the present invention is directed to an apparatus for retaining snow and/or ice on a roof and a method of installing such an apparatus, and various modifications may be made in the details within the scope and range of equivalents of the claims and without departing from the spirit of the invention.

What is claimed:

1. An apparatus for retaining and controlling the size of pieces of snow or ice accumulating on a top surface of a roof having seams comprising:

brackets secured to the top surface of a seamed roof with an attachment device, each bracket having at least one pocket; and a rail adapted to be seated in the pockets of the brackets, wherein the rail is capable of being positioned at or below the height of the seams.

2. The apparatus of claim 1 further comprising a channel in each bracket for receiving the seam, wherein the attachment device comprises apertures in the brackets, the apertures containing fasteners to engage the seams and to secure the brackets to the roof.

3. The apparatus of claim 2 wherein the fasteners are blunt-end screws and screws having a cup-shaped end engaging the seams on opposite side of the seams.

4. The apparatus of claim 1 wherein the brackets further comprise at least one slot capable of receiving the rail.

5. The apparatus of claim 4 wherein the rail is secured in the slot or the pocket with a retention device.

6. The apparatus of claim 5 wherein the retention device is a clip or a wedge.

7. The apparatus of claim 5 further comprising adhesive in the slot or the pocket to secure the rail.

8. The apparatus of claim 4 further comprising a plurality of slots, a plurality of pockets, and a plurality of rails seated in the slots and the pockets.

9. The apparatus of claim 1 wherein the brackets are constructed of at least one member selected from the group consisting of aluminum, steel, brass, copper, Kevlar, bronze, polycarbonate and other plastic resins, and alloys of aluminum, steel, brass, copper, Keviar, and bronze.

10. The apparatus of claim 1 wherein the rail is constructed of at least one member selected from the group consisting of aluminum, steel, brass, copper, Kevlar, bronze, polycarbonate and other plastic resins, and alloys of aluminum, steel, brass, copper, Kevlar, and bronze.

11. The apparatus of claim 1 wherein the cross-sectional shape of the rail is selected from the group consisting of square, rectangular, trapezoidal, rhomboid, parallelogram, triangular, and D-shaped.

12. The apparatus of claim 11 wherein a cap covers the ends of the rail.

13. The apparatus of claim 12 wherein the cap is plastic.

14. The apparatus of claim 1 wherein the rail is capable of being inserted into the brackets by lowering the rail into the pockets.

15. The apparatus of claim 4 wherein the rail is capable of being inserted into the brackets by sliding the rail into the slots.

16. An apparatus for retaining and controlling the size of pieces of snow or ice accumulating on a top surface of a roof comprising:

brackets secured to the top surface of the roof with an attachment device devices, each bracket having at least one pocket; and a rail adapted to be seated in the pockets of the brackets, wherein the rail is capable of being positioned at a low profile with the top surface of the roof and is capable of being inserted into the brackets by lowering the rail into the pockets.

17. The apparatus of claim 16 wherein the attachment devices are secured to the roof and the brackets, and the attachment devices are selected from the group consisting of screws, nails, bolts, spikes, a plate, a bar, and a strap.

18. The apparatus of claim 17 wherein at least one attachment device is a plate having a seam, the plate being secured to the roof by screws, nails, bolts or spikes, the brackets have a channel for receiving the seam, and the brackets have apertures containing fasteners to contact the seam and to secure the brackets to the plate.

19. The apparatus of claim 18 wherein the brackets are secured to the plate with blunt-end screws and screws having a cup-shaped end engaging the seams on opposite side of the seams.

20. The apparatus of claim 16 wherein the brackets further comprise at least one slot for receiving the rail.

21. The apparatus of claim 20 wherein the rail is secured in the slot or the pocket with a retention device.

22. The apparatus of claim 21 wherein the retention device is a clip or a wedge.

23. The apparatus of claim 21 further comprising adhesive in the slot or the pocket to secure the rail.

24. The apparatus of claim 20 further comprising a plurality of slots, a plurality of pockets, and a plurality of rails seated in the slots and the pockets.

25. The apparatus of claim 16 wherein the cross-sectional shape of the rail is selected from the group consisting of square, rectangular, trapezoidal, rhomboid, parallelogram, triangular, and D-shaped.

26. The apparatus of claim 25 wherein a cap covers the ends of the rail.

27. The apparatus of claim 26 wherein the cap is plastic.

28. The apparatus of claim 20 wherein the rail is capable of being inserted into the brackets by lowering the rail into the pockets.

29. The apparatus of claim 20 wherein the rail is capable of being inserted into the brackets by sliding the rail into the slots.

30. The apparatus of claim 16 wherein the brackets and rails are independently constructed of at least one member selected from the group consisting of aluminum, steel, brass, copper, Kevlar, bronze, polycarbonate and other plastic resins, and alloys of aluminum, steel, brass, copper, Kevlar, and bronze.

31. An apparatus for retaining and controlling the size of pieces of snow or ice accumulating on a top surface of a roof comprising:

brackets secured to the top surface of a seamed roof with blunt-end screws and screws having a cup-shaped end threaded through apertures in the brackets and engaging the seams on opposite sides of the seams, each bracket having pockets and slots and containing a channel for receiving the seam, the brackets being constructed of at least one member selected from the group consisting of aluminum, steel, brass, copper, Kevlar, bronze, polycarbonate and other plastic resins, and alloys of aluminum, steel, brass, copper, Kevlar, and bronze;

rails adapted to be seated in the pockets and slots of the brackets, wherein the rails seated in the pockets are capable of being positioned at or below the height of the seams, the rails seated in the slots are secured in the slots with a clip or a wedge and an adhesive, the cross-sectional sectional shape of the rails is selected from the group consisting of square, rectangular, trapezoidal, rhomboid, parallelogram, triangular, and D-shaped, and the rails are constructed of at least one member selected from the group consisting of aluminum, steel, brass, copper, Kevlar, bronze, polycarbonate and other plastic resins, and alloys of aluminum, steel, brass, copper, Kevlar, and bronze; and plastic caps covering the ends of the rails.

32. A method of installing a snow or ice retention apparatus on a roof comprising the steps of:

securing brackets to the roof, each bracket comprising pockets for supporting rails, being aligned to receive rails in the pockets, and capable of being positioned at a low profile with the top surface of the roof; and lowering the rails in the pockets of the brackets.

33. The method of claim 32 wherein the brackets comprise slots for receiving the rails and further comprising the step of sliding the rails into the slots.

34. The method of claim 32 wherein the roof has seams and the bracket securing step comprises engaging the brackets and roof seams with opposed blunt-end screws and screws having a cup-shaped end.

35. The method of claim 33 further comprising the step of securing the rails in the pockets or slots with a retention device after the step of placing the rails in the pockets or slots.

36. The method of claim 32 wherein the rails comprise square tubing.

37. The method of claim 32 wherein the rails comprise a square, solid rod.

38. The method of claim 32 wherein caps cover the ends of the rails.

39. A method of installing a snow or ice retention apparatus on a roof comprising the steps of:

securing brackets to the roof, the brackets comprising pockets for supporting rails and being aligned to receive rails in the pockets, the rails capable of being positioned at or below the seam of the roof; and lowering the rails in the pockets of the brackets.

40. The method of claim 39 wherein the brackets comprise slots for receiving the rails and further comprising the step of sliding the rails into the slots.

* * * * *